US010173221B2

(12) United States Patent
Bergman et al.

(10) Patent No.: US 10,173,221 B2
(45) Date of Patent: Jan. 8, 2019

(54) GYRATORY CRUSHER CRUSHING HEAD

(71) Applicant: SANDVIK INTELLECTUAL PROPERTY AB, Sandviken (SE)

(72) Inventors: Axel Bergman, Malmo (SE); Gustav Bern, Kalmar (SE); Bengt-Arne Eriksson, Svedala (SE); Mikael M Larsson, Eslov (SE); Patric Malmqvist, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 246 days.

(21) Appl. No.: 14/390,146

(22) PCT Filed: Mar. 19, 2013

(86) PCT No.: PCT/EP2013/055661
§ 371 (c)(1),
(2) Date: Oct. 2, 2014

(87) PCT Pub. No.: WO2013/149820
PCT Pub. Date: Oct. 10, 2013

(65) Prior Publication Data

US 2015/0108262 A1 Apr. 23, 2015

(30) Foreign Application Priority Data

Apr. 3, 2012 (EP) ..... 12162975

(51) Int. Cl.

| | |
|---|---|
| ***B02C 2/04*** | (2006.01) |
| *B02C 2/00* | (2006.01) |
| *B02C 2/02* | (2006.01) |
| *B02C 2/06* | (2006.01) |

(52) U.S. Cl.
CPC ..... *B02C 2/04* (2013.01); *B02C 2/00* (2013.01); *B02C 2/02* (2013.01); *B02C 2/06* (2013.01)

(58) Field of Classification Search
CPC .... B02C 2/06; B02C 2/04; B02C 2/00; B02C 2/02
USPC ..... 241/207–216, 285.1
See application file for complete search history.

(56) References Cited

U.S. PATENT DOCUMENTS

| | | | | |
|---|---|---|---|---|
| 1,791,584 A * | 2/1931 | Symons | B02C 2/045 241/216 |
| 3,384,312 A | 5/1968 | Patterson et al. | |
| 3,788,569 A | 1/1974 | Kemnitz | |
| 4,467,971 A | 8/1984 | Schuman | |
| 5,152,468 A * | 10/1992 | Virtamo | B02C 2/06 241/213 |
| 5,516,053 A * | 5/1996 | Hannu | B02C 2/005 241/207 |
| 5,575,428 A * | 11/1996 | Cordonnier | B02C 2/04 241/207 |

(Continued)

*Primary Examiner* — Anthony Stashick
*Assistant Examiner* — Onekki Jolly
(74) *Attorney, Agent, or Firm* — Corinne R. Gorski

(57) ABSTRACT

A gyratory crusher crushing head, removably mounted a crushing shell, includes a circumferential groove is formed in an outer facing surface of the crushing head. The groove is positioned towards a second lower end at the outward facing surface relative to an axial length of the crushing head. The groove and its relative axial positioning minimizes the stress concentrations at the crushing head resulting from forces tangential to the outward facing surface.

8 Claims, 3 Drawing Sheets

(56) References Cited

U.S. PATENT DOCUMENTS

| | | | | |
|---|---|---|---|---|
| 5,775,607 | A * | 7/1998 | Bayliss | B02C 2/047<br>241/207 |
| 5,779,166 | A * | 7/1998 | Ruokonen | B02C 2/06<br>241/213 |
| 2003/0102394 | A1* | 6/2003 | Martinez, Jr. | B02C 2/047<br>241/207 |
| 2007/0272780 | A1* | 11/2007 | Olsson | B02C 2/005<br>241/207 |
| 2009/0008489 | A1* | 1/2009 | Nieminen | B02C 2/047<br>241/207 |
| 2009/0294559 | A1* | 12/2009 | Eriksson | B02C 2/047<br>241/30 |
| 2010/0116915 | A1* | 5/2010 | Norrman | B02C 2/047<br>241/30 |
| 2010/0270409 | A1* | 10/2010 | Eriksson | B02C 2/005<br>241/207 |

* cited by examiner

GYRATORY CRUSHER CRUSHING HEAD

RELATED APPLICATION DATA

This application is a § 371 National Stage Application of PCT International Application No. PCT/EP2013/055661 filed Mar. 19, 2013 claiming priority of EP Application No. 12162975.2, filed Apr. 3, 2012.

TECHNICAL FIELD OF THE INVENTION

The present invention relates to a gyratory crusher crushing head for use in a gyratory crusher comprising a circumferential lifting groove formed in the outward facing surface of the crushing head.

BACKGROUND OF THE INVENTION

Gyratory crushers are used for crushing ore, mineral and rock material to smaller sizes. Typically, the crusher comprises a crushing head mounted upon an elongate main shaft. A first crushing shell is mounted on the crushing head and a second crushing shell is mounted on a frame such that the first and second crushing shells define together a crushing gap through which the material to be crushed is passed. A driving device is arranged to rotate an eccentric assembly arranged about the lower portion of the shaft so as to cause the crushing head to perform a gyratory pendulum movement and crush the material introduced in the crushing gap.

So as to replace the crushing shell mounted on the head, the crushing head, also commonly referred to as a head centre, is typically formed with means for attachment to a lifting mechanism so that the head centre and the shell may be lifted vertically upward via a crane. The wear parts may then replaced and any maintenance work performed within the crushing chamber. U.S. Pat. No. 5,323,976 discloses a cone shaped head centre having a series of holes formed in an upper end of the cone body to receive bolts for mounting brackets that are engageable by hooks of a lifting crane to remove the head vertically upward from the chamber.

These bore holes located in the very upper end of the crushing head are subject to high tangential stresses resultant from the head manufacturing process. Additionally, the holes at this location act to generate significant stress concentrations which in certain situations give rise to stresses that exceed the yield strength of the materials from which the crushing head is formed. An alternative embodiment is described in U.S. Pat. No. 3,355,114 in which mounting projections extending radially outward from the outer surface of the head centre, with these projections positioned at a lower region of the head in the axial direction.

However, there is a need for a crushing head that is attachable to a suitable lifting assembly or apparatus that minimises tension stresses and stress concentrations when both in use and when engaged by lifting mechanisms.

SUMMARY OF THE INVENTION

It is an object of the present invention to provide a gyratory crusher head that minimises stresses and in particular stress concentrations at the head during use to crush ore, mineral and rock materials and when engaged and lifted from a gyratory crusher by a lifting mechanism.

The objective is achieved in a first instance by providing a groove extending circumferentially around an outward facing surface of the crushing head and in a second instance by positioning this groove at a lower region of the crushing head in the axial direction. By forming the lifting mechanism engagement means as a circumferential groove, the critical stresses are aligned along the length of the groove in the circumferential direction giving rise to near zero or minimal stress concentrations that are otherwise created with conventional mounting bore or radial projection designs. Reference within this specification to a circumferential groove encompasses a groove extending in the circumferential direction relative to a longitudinal axis of the crushing head, the groove extending the entire circumference of the outward facing surface or a part of the 360° circumference.

Advantageously, by locating the groove at a lower region of the crushing head and in particular in close proximity to one (lower) end of the crushing head intended to be positioned below an opposed (upper) alternate end, in normal use, the groove is positionally far removed from the highly stress region of the head resultant from tangential tension stresses due to the closeness to the shrink fit. The location of the groove is further advantageously positioned to minimise stress as the crushing head is also subject to a load resultant from the crushing force as the head, via the crushing shell, acts against the opposed crushing shell mounted at the frame topshell. This force is typically distributed by an impact section of the outfacing surface of the head that comprises a generally frustoconical geometry. By positioning the lifting groove below the impact section of the head, the groove is affected by the action point of the force by only a small extent in contrast to mounting holes located above the action point of the force.

According to a first aspect of the present invention there is provided a gyratory crusher crushing head comprising: a first end for positioning at an upper region in a gyratory crusher relative to a second end for positioning at a respective lower region of the crusher; a surface extending between the first and second ends, the surface being generally outward facing relative to a longitudinal axis bisecting the crushing head; characterised by: a groove formed in the outward facing surface, the groove extending in a circumferential direction relative to the longitudinal axis of the crushing head.

Preferably, the crushing head further comprises a substantially frustoconical section extending between the first and second ends. Optionally, the crushing head further comprising a first cylindrical section extending between the first end and the frustoconical section.

Preferably, the crushing head further comprising a second cylindrical section positioned between the second end and the frustoconical section. Preferably, the groove is positioned at the second cylindrical section. Optionally, the second cylindrical section comprises an axial length in the range 10 to 20% of a total axial length of the crushing head.

Preferably, the crushing head as claimed in any preceding claim wherein the groove is aligned so as to extend from the outward facing surface in a direction substantially perpendicular to the longitudinal axis. Optionally, a depth of radial penetration of the groove into the head centre body, relative to the longitudinal axis, is substantially uniform along the circumferential length of the groove.

Preferably, the groove is positioned in one half of the crushing head in the axial direction closest to the second end. Preferably, the groove is positioned towards the second end in the axial direction.

Optionally, the groove is positioned at a distance 2 to 25% from the second end in the axial direction relative to a distance between the first and second ends. Optionally, the groove is positioned at a distance 5 to 15% from the second end in the axial direction relative to a distance between the first and second ends.

Preferably, the crushing head as claimed in any preceding claim wherein the groove is an endless circumferential groove formed in the outward facing surface. Alternatively, the circumferential groove may comprise a first and second groove end and extends over a part of the circumference of the crushing head. Optionally, the head centre comprises a plurality of grooves extending in the same axial plane and/or a plurality of grooves extending in different axial planes.

According to a second aspect of the present invention there is provided a gyratory crusher comprising a crushing head as described herein.

BRIEF DESCRIPTION OF THE DRAWINGS

The present invention will now be described, by way of example only, and with reference to the accompanying drawings in which:

Referring to FIG. 1, the gyratory crusher comprises a frame 113 having an upper frame part 101 and a lower frame part 107. A crushing head 103 is mounted upon an elongate main shaft 104. A first crushing shell 102 is fixably mounted on crushing head 103 and a second crushing shell 100 is fixably mounted at top frame part 101. A crushing zone 108 is formed between the opposed crushing shells 102, 100. A discharge zone 109 is positioned immediately below crushing zone 108 and is defined, in part, by lower frame part 107.

Figure 1:
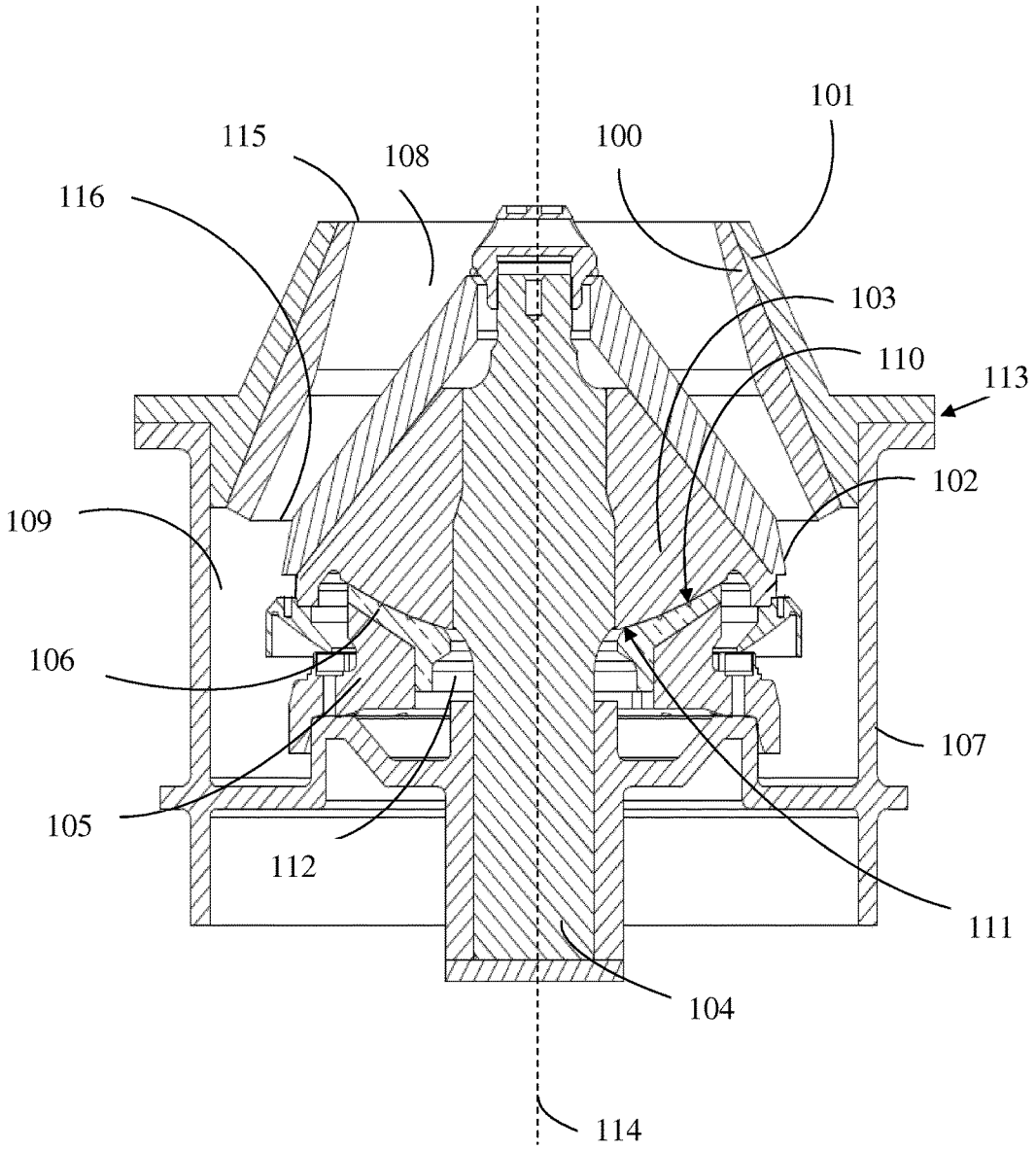
FIG. 1 is a cross sectional side view of a gyratory crusher in which a crushing head is mounted upon a bearing assembly according to a specific implementation of the present invention.

Relative to a longitudinal axis 114 extending through the crusher, the crushing head 103 and the main shaft 104, a diameter of a cross section of crushing zone 108 increases in the axial downward direction from an upper input end 115 to a lower discharge end 116. Accordingly, a spatial gap between the opposed crushing shells 102, 100 decreases in the axial downward direction from input end 115 to discharge end 116. As will be appreciated, the upper frame part 101 and lower frame part 107 surround the crushing head 103 and main shaft 104.

A drive motor (not shown) is coupled to main shaft 104 and via suitable gear mechanisms and drive shafts (not shown) positioned between the drive motor and main shaft 104. Accordingly, crushing head 103 and main shaft 104 are configured to rotate according to an eccentric rotational motion about the longitudinal axis 114. The spatial gap between the opposed crushing shells 102, 100 is thereby increased and decreased to crush the material introduced at input end 115, with crushed material being discharged into discharge zone 109 via discharge end 116.

The eccentric rotational motion of crushing head 103 is supported by a composite bearing assembly having bearing 106 positionally retained by a bearing support 105. Bearing 106 comprises a generally longitudinal annular configuration orientated around longitudinal axis 114. Bearing support 105 is also substantially and generally annular around longitudinal axis 114 and also has a length extending in a direction along axis 114 being approximately equal to a corresponding length of bearing 106.

Figure 2:
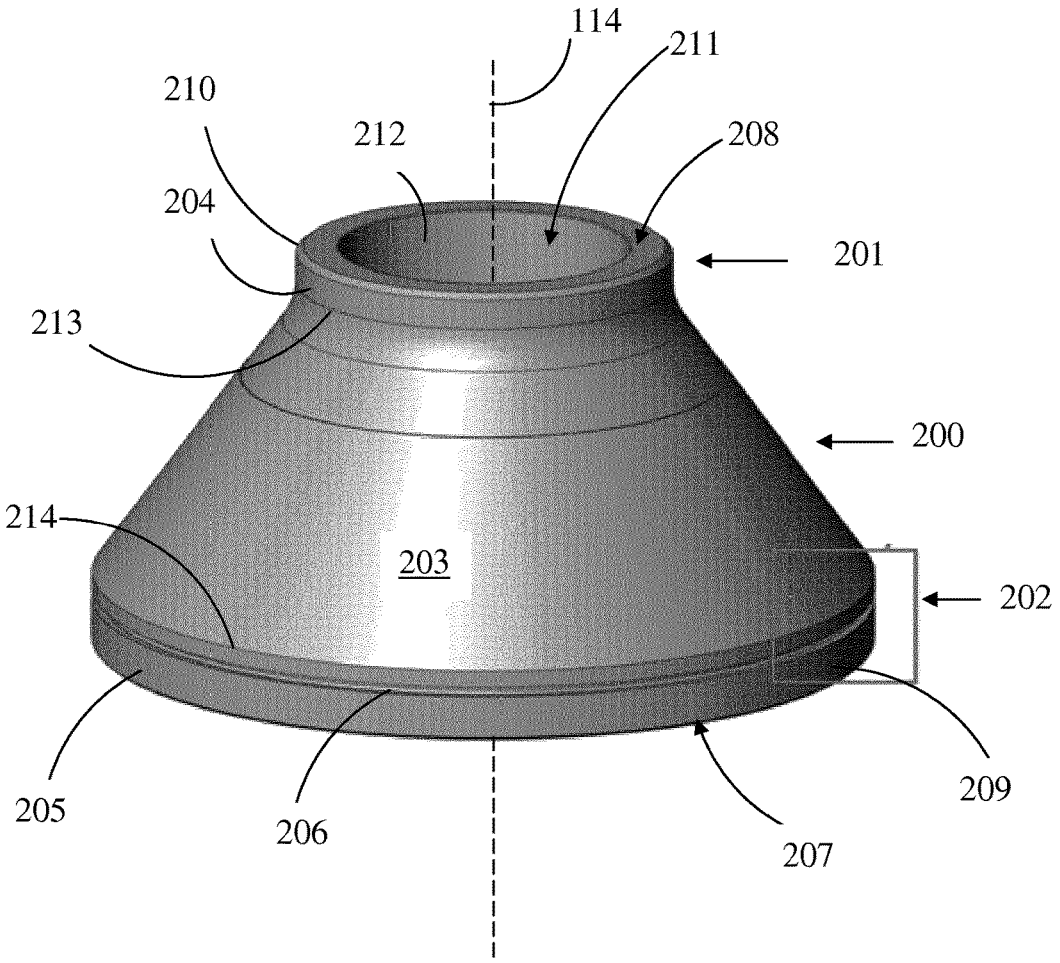
FIG. 2 is perspective external view of the crushing head of FIG. 1 according to a specific implementation of the present invention.

Bearing 106 comprises a bearing surface 110 configured to support crushing head 103 via mating contact with an opposed bearing surface 111 of crushing head 103. Bearing 106 has an internal bore 112 which is concentrically aligned with an internal bore 403 of bearing support 105. Accordingly, the longitudinal axis 114 passes centrally through the aligned internal bores 112, 403 when the bearing 106 and the support 105 are mounted together as a unitary assembly as shown in FIG. 2. The internal bores 112, 403 of the annular assembly 106, 105 surround a region of main shaft 104 and crushing head 103. As a diameter of bores 112, 403 is greater than a diameter of elongate shaft 104 and a lower region of crushing head 103, the crushing head 103 and main shaft 104 are capable of the eccentric rotational movement about longitudinal axis 114 whilst being supported and mounted by the bearing assembly 106, 105.

Figure 3:
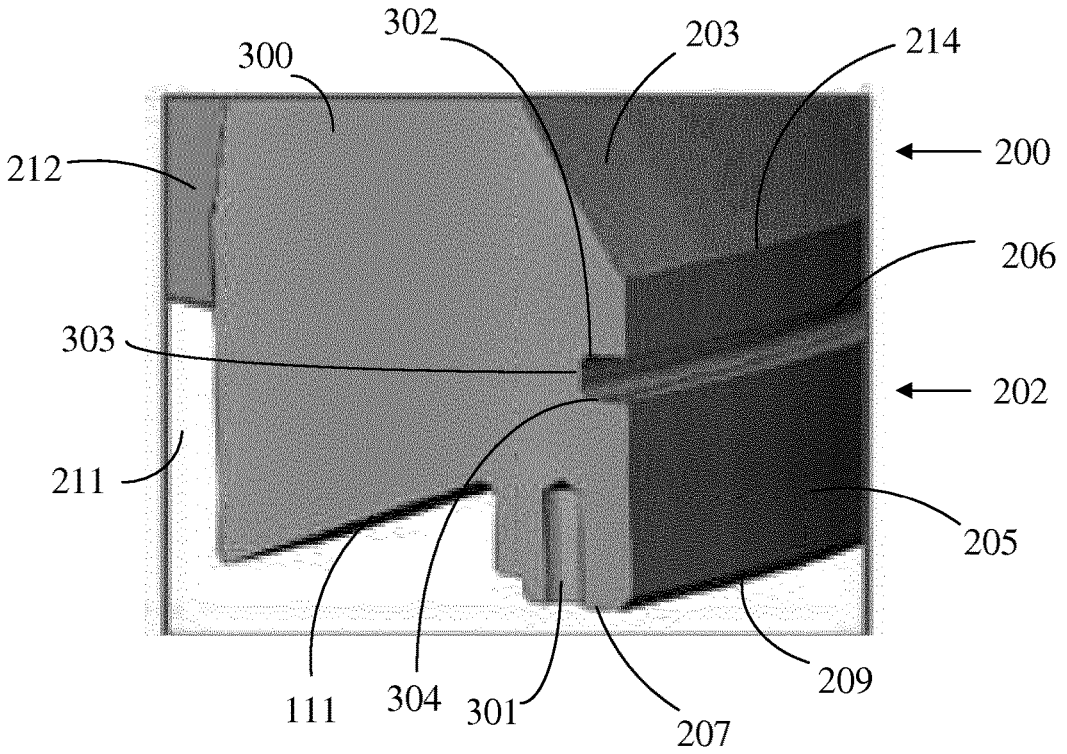
FIG. 3 is a partial cut away perspective view of a lower region of the crushing head of FIG. 2.

Referring to FIGS. 2 and 3, the crushing head 103, commonly referred to as a head centre, according to the specific embodiment, may be considered to comprise three sections in the axial direction, concentrically aligned and centred about longitudinal axis 114. Head 113, over the majority of its axial length, comprises an intermediate frustoconical section 200 having an external radius that increases in a downward direction from a first upward region 213 to a second lower region 214. An outward facing surface 203 relative to axis 114 thereby defines a frustum of a cone with surface 203 being circumferentially continuous or endless about axis 114. Surface 203 is generally intended to support crushing shell 102 and to withstand the impact loading forces resultant from material being crushed within zone 108.

Frustum section 200 is bordered at the upper region 213 by an axially relatively short cylindrical section 201 having outer cylindrical surface 204. The junction or interface between the outward facing surfaces 203 and 213 is seamless. Cylindrical section 201 is terminated at its uppermost end by annular surface 208 that defines a first end 210 of crushing head 113. A surface 212 is aligned to be inward facing relative to longitudinal axis 114 and extends the full axial length of crushing head 113 to define an internal bore 211. Bore 211 is suitably sized, with regards to its radius, to accommodate shaft 104 upon which head 113 is mounted such that head 113 and shaft 104 are configured to forma unitary assembly capable of gyroscopic rotation upon bearing 106.

Lower region 214 of the cone shaped section 200 is bordered by a second and lower axially short cylindrical section 202 relative to frustum section 200. As with the upper cylindrical section 201, the interface or junction between lower cylinder 202 and intermediate frustum 200 is seamless. Cylindrical section 202 is terminated at its lowermost end by an annular face 207 orientated to be downward facing relative to annular face 208 that is upward facing with both faces 207, 208 being aligned perpendicular to axis 114. An outward facing cylindrical wall 205 extends between junction region 214 and annular face 207 which, in combination with outward facing surfaces 203 and 204, collectively define the outward facing surface of crushing head 113 relative to longitudinal axis 114 and internal bore 211. The cylindrical outward facing surfaces 204, 205 are aligned substantially parallel with longitudinal axis 114 with cone surface 203 extending tangentially and intermediate between upper surface 204 and lower surface 205.

Head 113 comprises a circumferential groove 206 indented within lower cylindrical section 202. Groove 206 extends from outward facing surface 205 radially inward towards longitudinal axis 114. A depth or penetration of groove 206 into cylindrical section 203 is approximately 10 to 50 mm and is substantially uniform along the groove length. Groove 206 extends continuously around the circumference of cylindrical section 202 so as to be endless. Accordingly, force or stress at the crushing head 103 is transmitted along the circumferential length of groove 206 thereby avoiding the creation of stress concentrations which would otherwise fatigue head 103 and contribute ultimately to failure.

Groove 206 is accordingly positioned in an axial direction towards second end 209 relative to a full axial length of head 103. In particular, as the lower cylindrical section 202 represents approximately 14 to 18% of the total axial length of the crushing head 103, groove 206 is positioned at a distance from second end 209 being approximately 10% in the axial direction relative to the total axial length of the crushing head 103 between first end 210 and second end 209.

Groove 206 is formed as a channel having a pair of spaced apart parallel sidewalls 302, 304 that extend radially inward towards axis 114 from outward facing surface 205. Walls 302, 304 are aligned substantially perpendicular to axis 114. Walls 302, 304 are terminated at their radially innermost end by a bottom wall 303 aligned substantially parallel to axis 114 and substantially perpendicular to sidewalls 302, 304. An axial length of bottom wall 303 is approximately equal to an opening of the groove 206 at the outward facing surface 205. Accordingly, groove 206 is formed as a channel having a substantially rectangular or square cross sectional profile. As will be appreciated both i) the depth penetration, defined by the radial length of sidewalls 302, 304 and; ii) the channel width defined by the axial length of bottom wall 303 and the gap opening of groove 206 at surface 205, are variable and may be selected based on considerations of type of gyratory crusher within which head 103 is intended for use and the various other physical and mechanical properties of head 103, including axial length, diameter, choice of material of construction and type of lifting mechanism.

A further advantage of the endless circumferential groove 206 is that the tongues, hooks, members or claws of the lifting apparatus, used to remove vertically head 103 from the crushing chamber, may be inserted into any region of groove 206 in contrast to the discreet radially positioned mounting holes or radial projections of known crushing heads.

Accordingly, a lifting tool may be quickly and conveniently inserted into groove 206 to with a view to minimising the time taken for maintenance and/or component replacement.

The invention claimed is:

1. A gyratory crusher crushing head comprising:

a first end for positioning at an upper region in a gyratory crusher and a second end for positioning at a lower region of the crusher;

a substantially frustoconical section extending between the first and second ends;

a first cylindrical section extending between the first end and the frustoconical section, a junction between the first cylindrical section and the frustoconical section being seamless;

a surface extending between the first and second ends, the surface being outward facing relative to a longitudinal axis bisecting the crushing head;

a second cylindrical section positioned between the second end and the frustoconical section; and a groove positioned in the second cylindrical section and formed in the outward facing surface in an axial direction towards the second end, the groove extending in a circumferential direction relative to the longitudinal axis of the crushing head, wherein the groove is an endless groove formed as a channel having a substantially rectangular or square cross-sectional profile, wherein the channel is defined by a pair of parallel sidewalls aligned perpendicular to the longitudinal axis, the parallel sidewalls each being terminated at a radially innermost end by a bottom wall, the bottom wall being parallel to the longitudinal axis and having an axial length substantially equal to an opening of the groove at the outward facing surface.

2. The crushing head as claimed in claim 1, wherein the second cylindrical section has an axial length in the range 10 to 20% of a total axial length of the crushing head.

3. The crushing head as claimed in claim 1, wherein the groove is aligned so as to extend from the outward facing surface in a direction substantially perpendicular to the longitudinal axis.

4. The crushing head as claimed in claim 1, wherein the groove is positioned in one half of the crushing head in an axial direction closest to the second end.

5. The crushing head as claimed in claim 1, wherein the groove is positioned at a distance 2 to 25% from the second end in an axial direction relative to a distance between the first and second ends.

6. The crushing head as claimed in claim 1, wherein the groove is positioned at a distance 5 to 15% from the second end in an axial direction relative to a distance between the first and second ends.

7. The crushing head as claimed in claim 1, wherein the groove is positioned towards the second end in an axial direction.

8. A gyratory crusher including a crushing head, the crushing head comprising:

a first end for positioning at an upper region in the crusher and a second end for positioning at a lower region of the crusher;

a substantially frustoconical section extending between the first and second ends;

a first cylindrical section extending between the first end and the frustoconical section, a junction between the first cylindrical section and the frustoconical section being seamless;

a surface extending between the first and second ends, the surface being outward facing relative to a longitudinal axis bisecting the crushing head;

a second cylindrical section positioned between the second end and the frustoconical section; and a groove positioned in the second cylindrical section and formed in the outward facing surface, the groove extending in a circumferential direction relative to the longitudinal axis of the crushing head, wherein the groove is an endless groove formed as a channel having a substantially rectangular or square cross-sectional profile, wherein the channel is defined by a pair of parallel sidewalls aligned perpendicular to the longitudinal axis, the parallel sidewalls each being terminated at a radially innermost end by a bottom wall, the bottom wall being parallel to the longitudinal axis and having an axial length substantially equal to an opening of the groove at the outward facing surface.

* * * * *